United States Patent [19]

Birmelin

[11] Patent Number: 5,042,694

[45] Date of Patent: Aug. 27, 1991

[54] DISPENSER FOR PASTY COMPOSITIONS

[75] Inventor: Uwe Birmelin, Auggen, Fed. Rep. of Germany

[73] Assignee: Mega-Plast Dosiersysteme GmbH & Co., Wuppertal, Fed. Rep. of Germany

[21] Appl. No.: 456,110

[22] Filed: Dec. 22, 1989

[30] Foreign Application Priority Data

Dec. 24, 1988 [DE] Fed. Rep. of Germany ..... 3843759

[51] Int. Cl.[5] ..... B67D 5/56; B67D 5/40

[52] U.S. Cl. ..... 222/145; 222/207; 222/209; 222/212; 222/383; 222/386; 222/387; 222/380

[58] Field of Search ..... 222/94, 129, 136, 137, 222/145, 207, 209, 212, 321, 372, 383, 385, 386, 387, 380, 492, 522

[56] References Cited

U.S. PATENT DOCUMENTS

| | | | |
|---|---|---|---|
| 1,346,897 | 7/1920 | King | 222/492 |
| 2,789,731 | 4/1957 | Mauaffino | 222/129 |
| 3,305,127 | 2/1967 | Baranne | 222/522 X |
| 4,732,549 | 3/1988 | Von Schuckmann | 222/207 |
| 4,846,372 | 7/1989 | Schuckmann | 222/136 |
| 4,863,070 | 9/1989 | Andris | 222/207 |

FOREIGN PATENT DOCUMENTS

| | | | |
|---|---|---|---|
| 0861066 | 7/1949 | Fed. Rep. of Germany | 222/492 |
| 3616152 | 11/1987 | Fed. Rep. of Germany | 222/207 |
| 0340724 | 11/1989 | Fed. Rep. of Germany | 222/207 |
| 1459735 | 11/1966 | France | 222/207 |

*Primary Examiner*—Andres Kashnikow
*Assistant Examiner*—Kenneth DeRosa
*Attorney, Agent, or Firm*—Martin A. Farber

[57] ABSTRACT

A dispenser for pasty compositions has a delivery tube (3) with lateral passage openings (10) for a second component of a pasty composition developed in the delivery tube (3), and an elastically reformable pump element. The delivery tube (3) is closed by a valve body (19). A piston (33) is moveable through a housing of the dispenser in emptying direction upon reforming of the pump element. The lateral passage openings (10) for the passage of the second component can be closed by the same valve body (19), and the valve body is guided by means of a shaft in the delivery tube (3). In order to obtain in a manner simple to manufacture, a dispenser for pasty composition for possible delivery of pasty composition formed of several components, particularly an esthetically pleasing stripe formation, a stepwise widening of the delivery tube cross section which is developed in the direction of flow at the height of the upper valve-disk closure. Guide ribs for mating with the valve-disk.

7 Claims, 5 Drawing Sheets

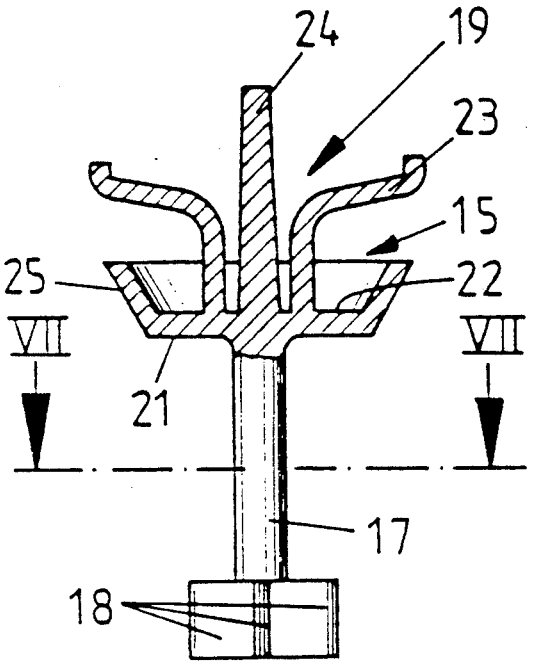
FIG. 5
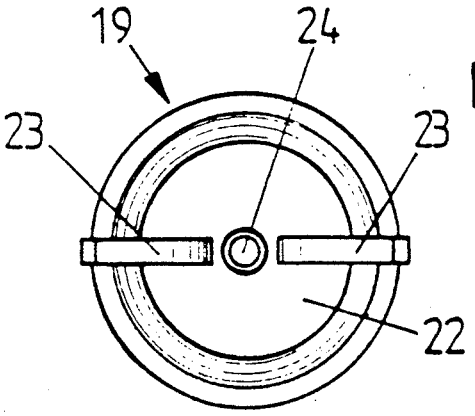
FIG. 6
FIG. 7
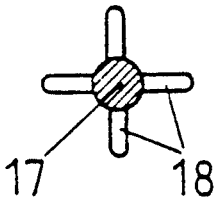

DISPENSER FOR PASTY COMPOSITIONS

FIELD AND BACKGROUND OF THE INVENTION

The present invention relates to a dispenser for pasty compositions.

The dispenser has a delivery tube and lateral passage openings for a second component of pasty compositions which are developed in the delivery tube. The dispenser also has an elastically reformable pump element. The delivery tube can be closed by a valve body through which a piston moves in the direction of emptying upon the reforming of the pump element. The lateral passage openings for the passage of the composition of the second component can also be closed by the same valve body (in accordance with West German Patent . . . , Patent Application P3,734,812.4-27).

Such dispensers are already known in various embodiments. In this connection, reference may be had, for example, to Federal Republic of Germany Patent 26 11 644. In that known dispenser, however, the delivery of pasty compositions having different components, for instance the formation of stripes by a second component on a main strand of pasty material of a first component, is not possible. In this connection it is already known, for instance from U.S. Pat. No. 1,969,395, to conduct the main strand of a material through the hollow shaft of a closure valve. This measure is also known from U.S. Pat. No. 1,346,897. In the latter patent this measure is utilized in order to provide for lateral emergence of the pasty composition, the valve being urged by spring into its closed position, thus resulting in automatic closure.

From German Patent EP-B1 54 212 a dispenser is known in which the delivery of pasty composition of a second component in order to form stripes on the main strand of the first component is possible. For this purpose, that Patent proposes arranging alongside of the delivery tube for the main strand, a second delivery tube which communicates in the outlet region of the first delivery tube with the latter via communication openings. Furthermore, in that Patent, there is assumed known a dispenser on the delivery end of which there is an insert which has an outlet tube which extends coaxially to the longitudinal axis of the container and an annular space surrounding said outlet tube, said annular space being connected via communication holes with the outlet tube. In both of the last-mentioned dispensers, the advancing of the piston is, however, effected by a rod which is connected to the actuating handle and along which the piston slides upward upon actuation.

Furthermore, from Federal Republic of Germany OS 34 08 762 a dispenser is known in which the delivery tube can be closed by means of a valve bonnet which is formed directly on the wall of the delivery tube. For a pasty composition of a second type, for instance a second color, an annular space is created by means of the delivery tube below the pump piston, said space being in communication with the delivery tube via special channels. The channels debouch in the direction of flow above the valve bonnet which is arranged in the delivery tube. The pasty composition of second color which is present in the annular space is sealed off by a separate non-return valve which circularly surrounds the outside of the delivery tube. Thus two valves are necessary. In addition, the non-return valve which circularly surrounds the delivery tube in its lower region reduces the size of the annular space for the pasty composition of second color. Furthermore, relatively long passage channels for the pasty composition of second color must be created in order to introduce the pasty composition into the delivery tube at a distance from the valve arranged in the delivery tube and above it. In that dispenser the pasty composition is conducted, so to speak, in bypass around the valve for the main strand in the delivery tube.

SUMMARY OF THE INVENTION

As compared with this prior art, the object of the present invention is to develop a dispenser for pasty composition in a manner which is simple to manufacture and advantageous in use for possible delivery of pasty composition which consists of several components, and, in particular, to create an aesthetically attractive formation of stripes.

This object is achieved with a dispenser provided, in accordance with the invention, with a step-like widening (8) of the outlet-tube cross section which is developed in the direction of flow at the height of the upper valve-disk closure and by guide ribs (16) for the valve disk (15) which are left in the widened region.

The dispenser of the invention further develops the principle already described above in the manner that the passage openings for the component of the second composition are arranged in the region of the valve disk seat, and this same valve disk closes both the passage openings for the second composition and the main strand. The passage openings which can be closed by the valve body prevent the composition of the second component from being drawn back (in part) upon the follow-up movement of the piston and, in this connection, to prevent composition of the first component from entering into the space of the composition of the second component. It is essential that in the direction of flow of the pasty composition stepwise widening of the cross section of the outlet tube be developed at the height of the upper valvedisk closure and that guide ribs for the valve disk are developed in the region of the widening. After passing through the valve zone, space is created for the main strand with the stripes applied. Chambers, so to speak, are formed in which the formation of the stripes, in particular, can take place without impairment and in which, in particular, the transport is improved.

The valve body which closes the main strand as well as the passage openings or the second composition can be spring-loaded. It can, for instance, rest by means of spring legs formed on the valve body against a region of the delivery tube which extends above the valve body. By means of the spring loading a pressure load can be established upon the delivery pump movement. In principle, operation of the dispenser of the invention is possible, however, also without the spring loading solely on the basis of the movement of the valve body in the composition during the pump movement.

As a further development it is provided that the shaft of the valve body which extends into the extension of the delivery tube, which dips into the pump space or the storage space, forms a crossbar for application against the inner wall of the delivery tube. This crossbar creates an advantageous guidance of the shaft in the delivery tube while at the same time leaving a sufficient cross section of passage for the pasty composition. At the same time, a certain dividing up of the strand of composition can be obtained also by means of the crossbar, particularly if the profile of the cross bar is continuous up to the valve disk. It is furthermore preferred that the cross bar be developed at least at the end of the shaft, on the end facing away from the valve disk.

As a further development it is provided that the valve disk itself be developed in cup shape, with conically extending sides for the closing of the passage openings for the second composition. The outlet tube itself has a continuous course in the region of the valve seat so that the conical sidewalls of the cup-shaped valve disk can cooperate with the delivery tube in sealing fashion lying fully thereon.

Another particular development provides that the passage openings for the second composition debouch on the storage-space side within a step. The cross section of the passage openings on the inside of the delivery tubes extend ovally through mouths in the conical region, as seen in side view. On the other hand, the openings on the storage-space side are circular (as viewed from below) due to the development of the step. There is obtained a well-defined introduction and development of the strand of second component. The storage space for the composition of second component is formed in detail by the annular space which results between the storage-space side extension of the delivery tube and a pump bellows surrounding it. This pump bellows is characterised by the fact that the head-side end part of the bellows is developed as a substantially cylindrical connecting piece. The cylindrical connecting piece is not compressible upon movement of the pump. It represents a calmed - top-section of the storage space for the second composition.

It is furthermore important that the head-side end-part of the bellows forms a radially inwardly protruding sealing collar. This head-side end-part lies against the storage-space-side wall of a cup part 26 which furthermore also forms the delivery-tube extension which dips into the storage space. The connecting piece furthermore forms an upwardly open annular groove which forms a double sealing lip. Over its circumference it is passed through by a plurality of radially directed ribs which increase the stability.

BRIEF DESCRIPTION OF THE DRAWINGS

The invention is explained in further detail below with reference to the accompanying drawing which, however, shows merely one embodiment. In detail:

FIG. 5 is a view of the valve body on a larger scale;

FIG. 6 is a top view of the object of FIG. 5;

FIG. 7 is a cross section through the object of FIG. 5, along the line VII—VII;

DETAILED DESCRIPTION OF THE PREFERRED EMBODIMENT

Figure 1:
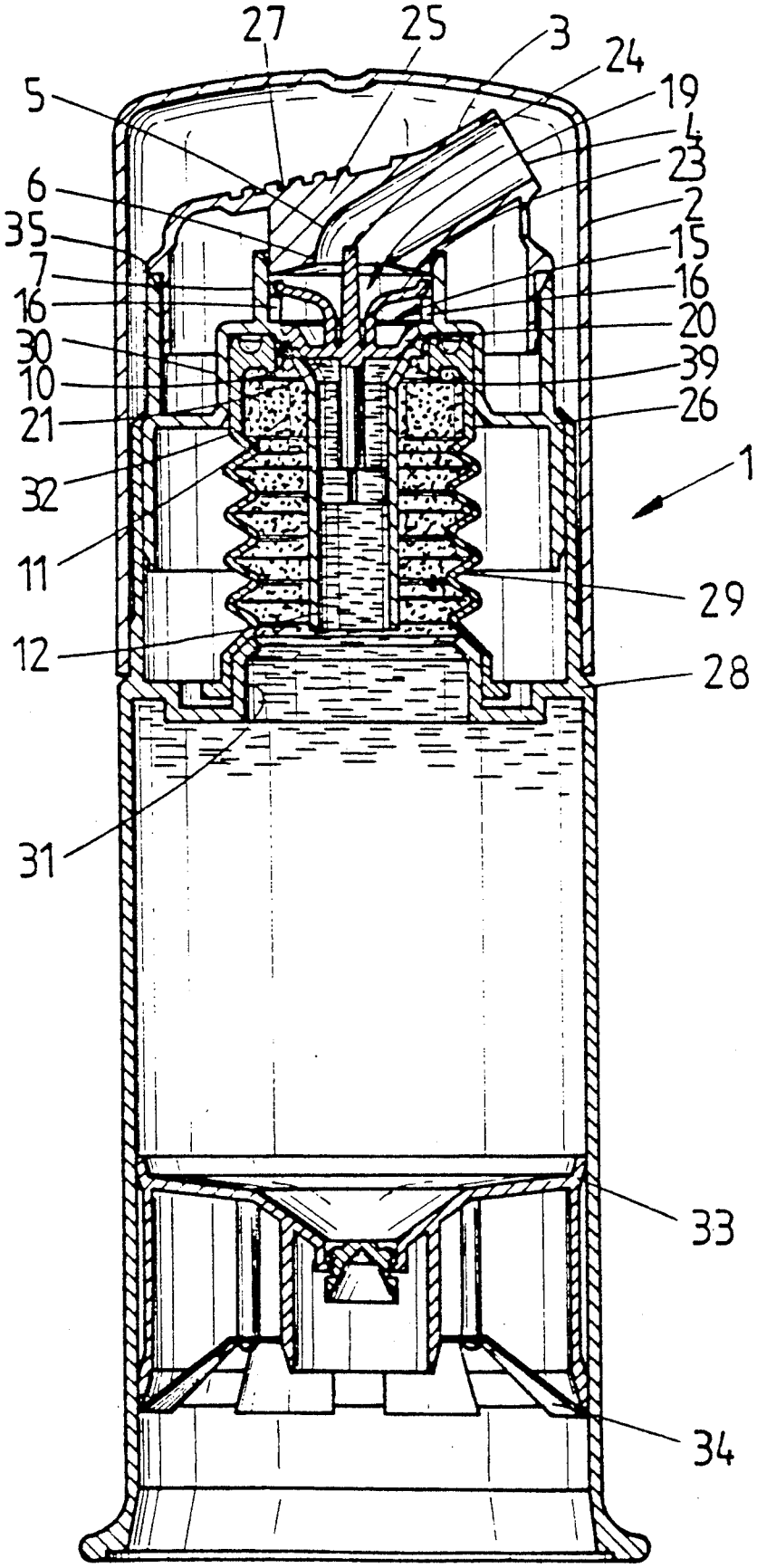
FIG. 1 is a cross section through the dispenser of the invention.
Figure 3:
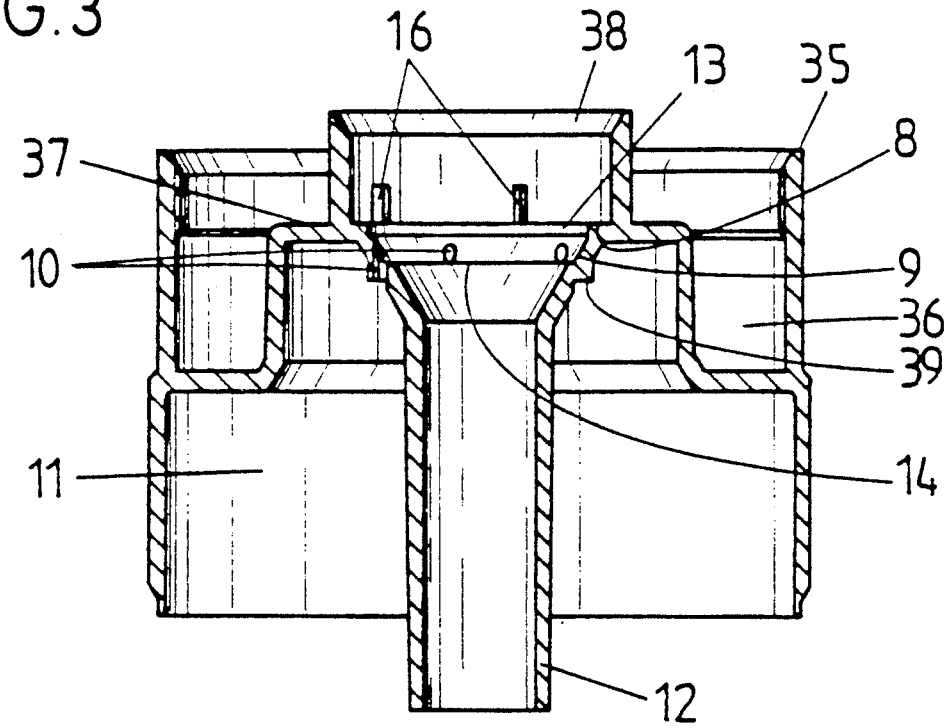
FIG. 3 is a cross section, in enlarged view, through the dispenser-head part which forms the part of the delivery tube forming the valve seat, together with the extension which extends into the storage space of the composition.

There is shown and described a dispenser 1, which is closed by a cap 2 in FIG. 1. The dispenser 1 has a delivery tube 3 which has a delivery opening 4. The cross section of the delivery opening 4 is continued via a curvature 5 up into a transition cross section 6. From here, seen in continuation in direction opposite the direction of flow, the delivery tube widens over a very large conical angle to a substantially larger cross section 7. This cross section 7 is about twice as large and, in the embodiment shown, even more than twice as large, as the cross section of the delivery tube 3 in the region of the transition cross section 6 of the delivery opening 4. Below the cross section 7, as can be noted in particular, for instance, from FIG. 3, the delivery tube passes via a step 8 into the valve-seat region 9. The length of the section 7 corresponds to approximately half of the diameter in this region. It may even be shorter. Within this conically extending valve-seat region 9 the passage openings 10 for the pasty composition of a second component debouch. This second component is present in the circumferential space 11 which surrounds an extension 12 of the delivery tube 3 in the pump chamber and/or the storage chamber.

In the valve-seat region 9, or in its upper and lower regions, there are furthermore developed two additional small steps, a substantially vertical step 13 and a substantially horizontal step 14. The horizontal step 14 is advantageous in that the commencement of the formation of the stripes is not squeezed, even in the closed condition. Nevertheless, particularly by means of the similarly conical development of the valve disk 15, as will be described in further detail below, and in cooperation with the step 13 a closure is possible in the closed state.

Below the step 14, the conical region of the delivery tube 3 continues further and then debouches into the cylindrical extension 12 of the delivery tube. This extension 12 has approximately the same diameter as the delivery opening 4.

It is essential that ribs 16 are developed, starting from the horizontal step 8 and extending upward in direction of flow. Upon actuation of the dispenser, as shown, for instance, in FIG. 2, the valve disk 15, which lifts off is guided by the ribs 16. By the simultaneous guidance by means of the crossbar 18 developed on the shaft 17 which crossbar is guided on the inner wall of the extension 12, a simultaneous lifting off of the entire valve disk and a displacement parallel to the closure plane is reliably achieved. The step-like widening (seen in direction of flow) by the step 8, connected also with the guide ribs 16, permits an advantageous formation of stripes upon the passage, upon a pump stroke, of the component of second composition through the openings 10. On the storage-chamber side, the passage openings 10 debouch in the steps 39 in their horizontally extending section. The step 39 can advantageously be developed as a circumferential annular shoulder.

Figure 2:
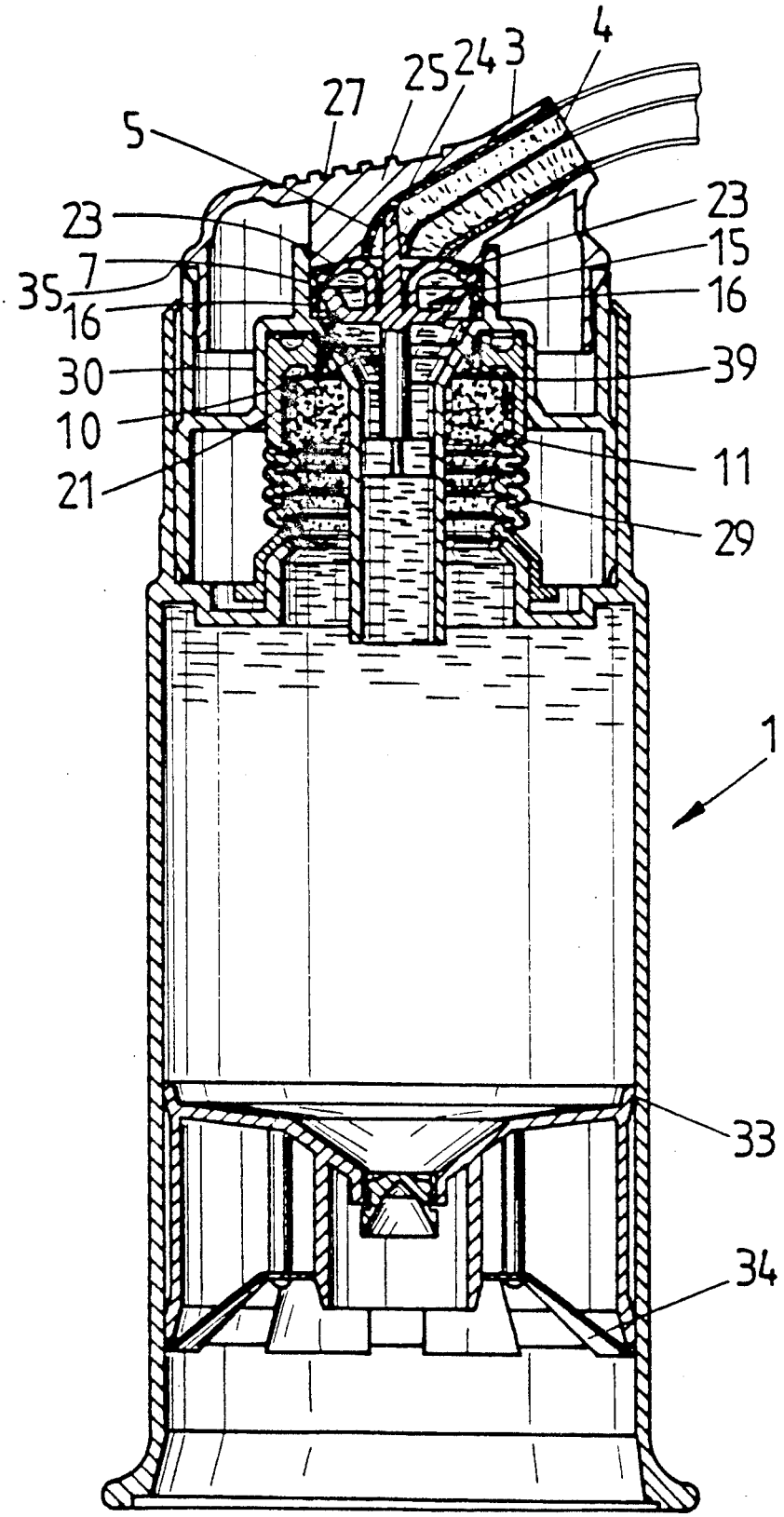
FIG. 2 is a view similar to FIG. 1 but in the actuated position.

FIGS. 5 to 6 show the closure valve 19 in detail. As already mentioned, it has a valve disk 15 which forms conical side walls 20, and a valve-disk bottom 21. The valve disk 15 is open towards the top. From the mouth-side surface 22 of the valve-disk bottom 21, the spring legs 23 extend out as well as an assembly aid 24 in the form of a mandrel. The assembly aid 24, as can be noted, for instance, from FIG. 2, is also a stop for the movement of the valve upon a pump stroke.

The valve bottom 21 continues downward in a central shaft 17 on the end of which the said crossbars 18 are formed. FIG. 7 is a cross section through the valve shaft.

The dispenser is constructed in detail as follows: the upper part of the delivery tube 3, together with the delivery opening 4 and the transfer section 6, is developed in a separate part 25 which is placed on a cup part 26 within which the extension of the delivery tube is also developed. The handle 27 is also formed on the part 25. The cup part 26 forms the delivery-tube extension 7 having the aforementioned increased cross-section. The spring legs 23 of the valve rest against the bluntly conical lower widening surface of the delivery tube 3 developed in the part 25.

Figure 9:
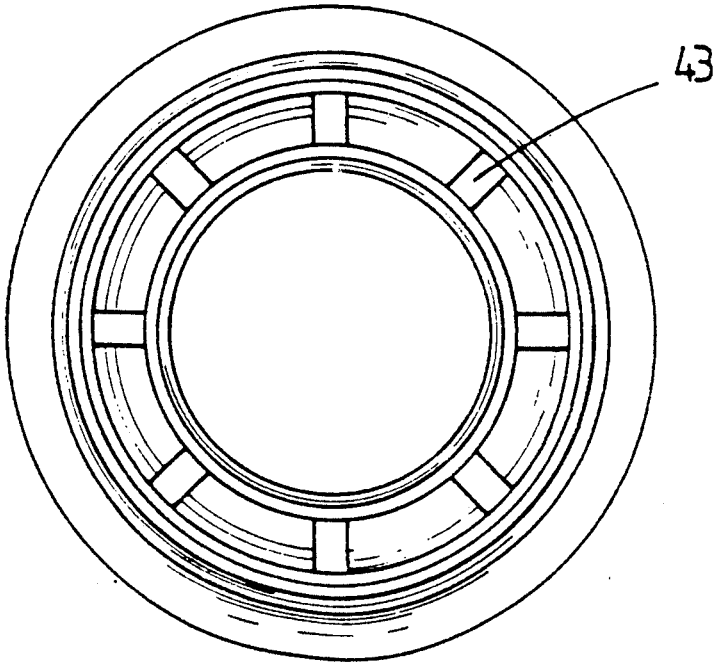
FIG. 9 is a top view of the object of FIG. 8.

The cup part 26 is mounted for axial movement in the dispenser housing 28. The return is obtained by the elastic pump bellows 29 which is mounted, on the one side, in the upper part of the cup part 26 in the downwardly open region 30 and rests, on the other side, on a connecting socket 31 in the dispenser housing 28. The connection of the bellows 29 to the cup part 26 is effected in detail by a connecting piece 32. The connecting piece 32 is molded directly on the bellows 29. It consists of a cylindrical section 40 and the radially inward extending upper sealing collar 41. Within the sealing collar 41 there is developed an upwardly open annular groove 42 which, as can be noted in particular from FIG. 9, is subdivided over its circumference by radially directed arms 43. An inner sealing lip 48 and an outer sealing lip 44 result. The lowermost fold 45 of the bellows 29 also passes into a cylindrical section 46 which terminates in a radially outwardly directed step 47. In this section the pump bellows 29 is seated on the connecting socket 31. The paste composition is stored not only in the connecting piece 32 but also in the bellows 29, in each case in the circumferential space around the delivery-tube extension 12, as can be noted, for instance, from FIG. 2.

Figure 4:
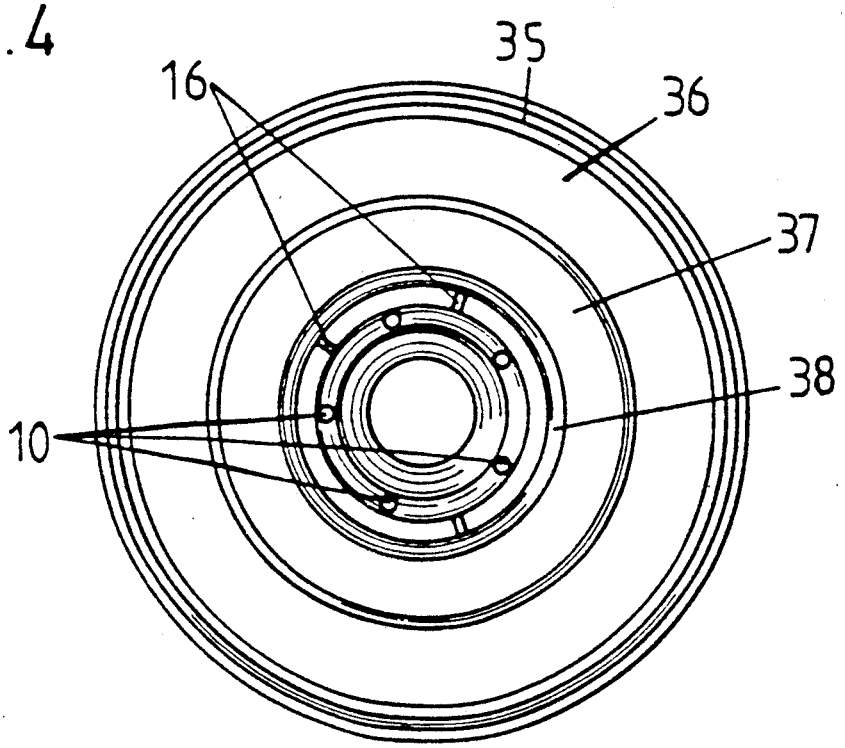
FIG. 4 is a top view of the object of FIG. 3.
Figure 8:
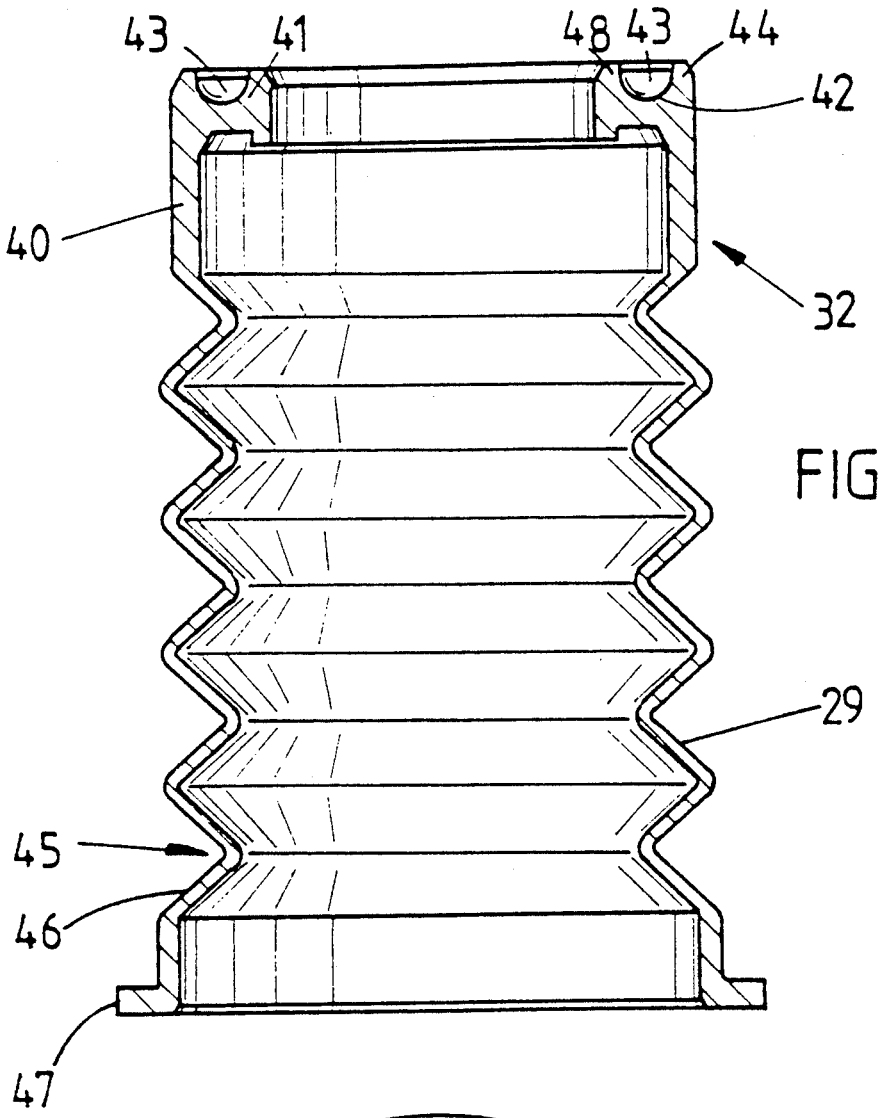
FIG. 8 is a longitudinal section through the pump bellows with connecting piece formed thereon.

In the lower region of the dispenser housing 28, a follow-up piston 33 with a spring lock 34 is present, in known manner. From the top view of FIG. 4 of the part of the cup shown in FIG. 3, the development of the cup part can be noted in detail. In the outer edge 35, the part 25 which contains the delivery tube 3 is pushed in. Towards the inside adjoining this, there is an annular space 36 which passes into a step 37. This step on the one side, forms a collar 38 which, as explained further above, forms the region of the delivery tube 3 of enlarged cross section 7. On the other side, the downwardly conically tapering region 9 of the delivery tube 3 which passes into the extension 12 is formed inwardly on the step 37.

I claim:

1. A dispenser for pasty composition, comprising:

a housing and a moveable piston within the housing defining a chamber for enclosing a first component of the pasty composition;

a delivery tube and a valve body interposed in the delivery tube, the delivery tube communicating with said chamber for dispensing the first component of the pasty composition, there being an annular space encircling said tube and being enclosed by a forward portion of said housing adjacent said valve body for containing a second component of the pasty composition; and wherein there are lateral passage openings communicating with said annular space for dispensing the second component of pasty composition, the lateral passage openings being developed in the delivery tube;

the dispenser further comprises an elastically reformable pump element, the delivery tube being closed by the valve body, the piston being moveable through the housing in emptying direction upon a reforming of the pump element, the lateral passage openings also being closed to passage of the second component by said valve body;

the dispenser comprises a shaft for guiding the valve body in the delivery tube, a portion of the delivery tube being configured as a valve seat for receiving the valve body;

the valve body includes a valve disk;

there are guide ribs disposed along an inner surface of the delivery tube; and there is a step-like widening of the delivery tube cross section which is developed in the direction of flow at the height of an upper valve-disk closure, said guide ribs engaging with the valve disk, the guide ribs being disposed in the widened region of the delivery tube.

2. A dispenser according to claim 1, wherein said valve disk has a cup-shaped form with conically extending sides for closing the passage openings to the second component of the pasty composition.

3. A dispenser according to claim 1, wherein there is a step on the outer side of said delivery tube; and said passage openings for the second component of the pasty composition debouch on the outer side of the delivery tube within the step.

4. A dispenser according to claim 1, wherein said pump element comprises a pump bellows, the head-side end part of the bellows being formed as a substantially cylindrical connecting piece for the development of a calmed section for the pasty composition.

5. A dispenser according to claim 4, wherein the head-side end part of the bellows comprises a radially inwardly protruding sealing collar; and an upwardly open annular groove disposed along the collar.

6. A dispenser according to claim 1, further comprising a crossbar disposed on said shaft for application against the inner wall of the delivery tube.

7. A dispenser according to claim 6, wherein said crossbar is located at the end of the shaft distant from said valve body.

* * * * *